US007412965B1

(12) United States Patent
Laermann et al.

(10) Patent No.: US 7,412,965 B1
(45) Date of Patent: Aug. 19, 2008

(54) EXHAUST CONTROL SYSTEM FOR AN INTERNAL COMBUSTION ENGINE

(75) Inventors: Martin Laermann, Clarkston, MI (US); Dean Tomazic, Orion Township, MI (US); Marek Tatur, Auburn Hills, MI (US); Taylor W. Holland, Grosse Pointe Farms, MI (US); Jeffrey T. Dowell, Windsor (CA)

(73) Assignee: AM General LLC, South Bend, IN (US)

( * ) Notice: Subject to any disclaimer, the term of this patent is extended or adjusted under 35 U.S.C. 154(b) by 0 days.

(21) Appl. No.: 11/735,110

(22) Filed: Apr. 13, 2007

(51) Int. Cl.
*F02D 43/00* (2006.01)
*F01N 3/00* (2006.01)

(52) U.S. Cl. ..... 123/399; 60/274; 60/602; 123/480; 123/568.21; 123/676; 701/102

(58) Field of Classification Search ..... 123/399, 123/480, 568.21, 673, 676; 60/274, 276, 60/285, 602; 701/101, 102, 103, 109
See application file for complete search history.

(56) References Cited

U.S. PATENT DOCUMENTS 5,880,952 A * 3/1999 Yasui et al. ..... 701/103
6,371,097 B1 * 4/2002 Rossi ..... 123/691
6,698,186 B2 * 3/2004 Ueno et al. ..... 701/103
6,920,388 B2 * 7/2005 Yasui ..... 701/109

* cited by examiner

*Primary Examiner*—T. M Argenbright
(74) *Attorney, Agent, or Firm*—Gifford Krass Sprinkle Anderson & Citkowski

(57) ABSTRACT

An exhaust control system for an internal combustion engine having a plurality of actuators wherein each actuator controls a predetermined engine parameter. A plurality of sensors are also associated with the engine and each sensor provides an output representative of an engine operating condition. The control system includes a PID controller associated with each actuator and in which each PID controller has an input, an output and a feedback between the input and the output. A distribution function circuit is operatively connected in series with the inputs of the PID controller. The distribution function circuit receives an error signal representative of the difference between a target value and an actual value of one or more engine operating conditions, previously determined control factor values and the feedback from each PID controller as input signals. The distribution function circuit varies the input to each PID controller as a function of the distribution function input signals.

17 Claims, 6 Drawing Sheets

Actual Value
Controller Setpoint
UEGO O2 Concentration
Error SFI PID
Error TV PID
Error EGR PID
Error PCR PID
Distribution Error To PID (-)
SFI PID Out
TV PID Out
EGR PID Out
PCR PID Out
PID Out To Actuator (-)
Time (sec)
t1
t2
t3

Temperature Before DPF
Temperature Setpoint
Temperature (C)
800
700
600
500
400
300
200

Error SFI PID
Error TV PID
Error EGR PID
Error PCR PID
Distribution Error To PID (-)
200
150
100
50
0
-50
-100

SFI PID Out
TV PID Out
EGR PID Out
PCR PID Out
PID Out To Actuator (-)
35
30
25
20
15
10
5
0
0
100
200
300
400
500
600
700
Time (sec)

EXHAUST CONTROL SYSTEM FOR AN INTERNAL COMBUSTION ENGINE

BACKGROUND OF THE INVENTION

I. Field of the Invention

The present invention relates generally to control systems and, more particularly, to a control system for controlling the exhaust system of an internal combustion engine.

II. Description of Related Art

Modern internal combustion engines include numerous actuators which vary the operation of the internal combustion engine. Such actuators include, for example, exhaust gas recirculation actuators, boost valve actuators and, supplemental fuel injection actuators. The exhaust gas recirculation (EGR) actuator controls the amount of the exhaust gas recirculated to the intake of the engine while the boost control actuator controls the pressure from a turbine at the engine air intake. A throttle control actuator controls the position of the throttle valve while a supplemental fuel injection actuator controls the injection of supplemental fuel either into the engine or into the exhaust system.

The actuation of these various actuators controls various engine operating conditions. Such engine operating conditions include, for example, the exhaust gas temperature and the air/fuel ratio or lambda of the engine.

In order to control the actuation of these engine actuators for optimal engine performance, the previously known systems have associated a PID controller with each of the actuators. These PID controllers, furthermore, operate independently of each other.

Since the variation of one of the actuators, e.g. the exhaust gas recirculation, affects the other engine operating conditions, these previously known control systems have relied upon a microprocessor based engine management unit to control the degree of actuation of the actuators for optimal engine performance. In order to determine the proper amount of actuation for each actuator, the previously known engine management units have relied upon extensive software mapping and software lookup tables to determine the proper amount of actuation for each controller. As such, these previously known engine control systems were necessarily disadvantageously software intensive.

SUMMARY OF TEE PRESENT INVENTION

The present invention provides a control system for an internal combustion engine particularly well suited for controlling the exhaust system which overcomes all of the above-mentioned disadvantages of the previously known devices.

In brief, like the previously known systems, the system of the present invention is provided for use with an internal combustion engine having a plurality of actuators where each actuator controls a predetermined engine parameter. These engine parameters may include, for example, the exhaust gas recirculation, throttle valve position, supplemental fuel injection and boost pressure.

A plurality of sensors are also associated with the engine and each sensor provides an output signal representative of an engine operating condition. For example, a lambda sensor is typically associated with the exhaust gas stream which provides an output signal representative of the air/fuel ratio for the engine. Other sensors may include the temperature of the exhaust gas stream, the boost air pressure, throttle position sensor, speed sensor, power sensor, ambient temperature, etc.

A PID controller is associated with each actuator to control the degree of actuation of that actuator. In the conventional fashion, each PID controller includes an input, an output and a feedback from the output.

Unlike the previously known systems, however, a distribution function circuit is operatively coupled in series with the inputs of the PID controllers. This distribution function circuit also receives an error signal representative of the difference between a target value and an actual value of one or more engine operating conditions.

The distribution function circuit also receives the feedback from each PID controller as an input signal as well as previously determined control factor values. Such control factor values may be determined empirically, through computer modeling or otherwise.

In operation, the distribution function varies the input to each PID controller as a function of the inputs to the distribution function circuit. As such, the output from each PID controller also forms an input variable for the inputs of the other PID controllers.

In practice, the control factor inputs to the distribution function circuit provide a simple yet effective mechanism for weighing the impact of the output from each PID controller on the operation of the other PID controllers. As such, the weight afforded to the output from a particular PIE) controller is adjusted as required to achieve the desired or target engine operating condition and thus optimal engine operation.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figure 1:
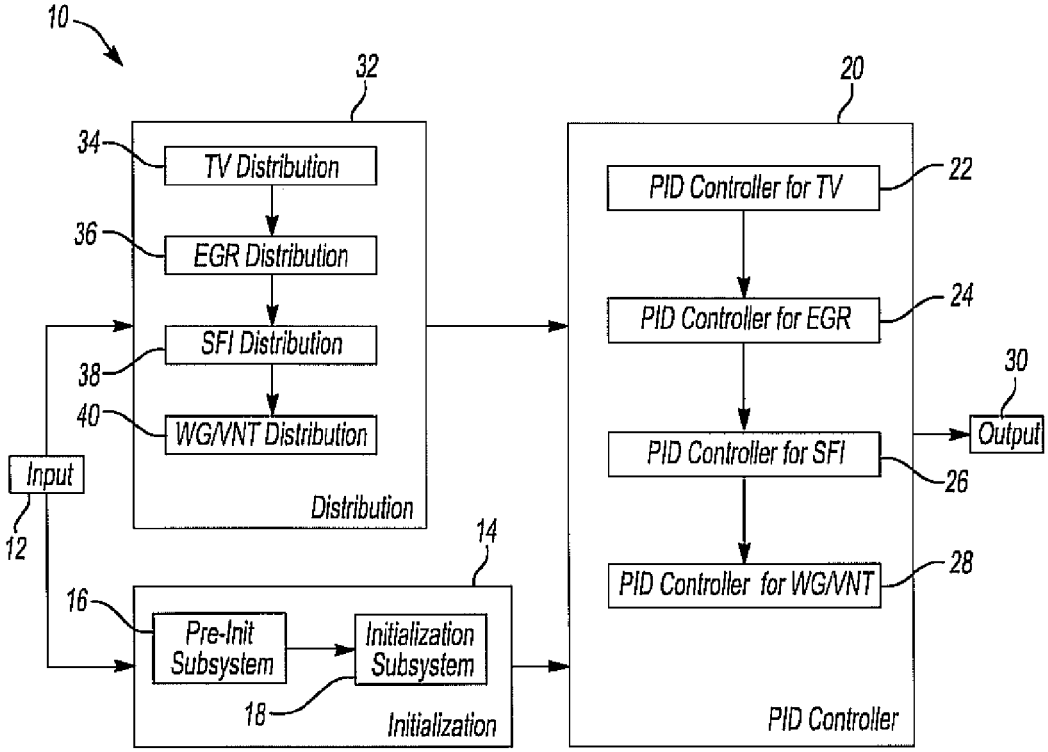
FIG. 1 is a simplified block diagrammatic view illustrating a preferred embodiment of the engine control system.

With reference first to FIG. 1, a simplified block diagrammatic view of a control system 10 is illustrated. The control system 10, furthermore, will be described for use as an exhaust system control for an internal combustion engine. However, no undue limitations should be drawn therefrom since the control system may be utilized to control other aspects of the internal combustion engine.

The control system 10 receives an input 12 from appropriate engine sensors representative of various engine operating conditions. These engine operating conditions can include, for example, the air/fuel ratio, the exhaust gas temperature, the boost pressure from an intake turbine, engine speed sensor, power sensor, ambient temperature, and the like.

The input 12 is provided to an initialization block 14 containing both a preinitialization subsystem 16 as well as an initialization subsystem 18. The preinitialization system 16 is desirable where there is a long delay between the access to the controller from a subcomponent and the controller itself. Without the preinitialization system 16, the controller could be in an undefined status for a long time. Upon engine startup, the preinitialization subsystem 16 together with the initialization subsystem 18 determines the initial desired values for the various actuators associated with the engine. These actuators, for example, may include a throttle valve actuator, an exhaust gas recirculation actuator, a supplemental fuel injection actuator and a waste gate or variable nozzle boost actuator.

An output from the initialization block 14 is coupled as an input to a PID controller block 20. The PID controller block 20, as illustrated in FIG. 1, includes a PID controller 22 for the throttle position, a PID controller 24 for the exhaust gas recirculation controller, a PID controller 26 for the supplemental fuel injection actuator and a PID controller 28 for the waste gate or variable nozzle turbine boost actuator. The PID controller outputs 30 from the PID block 20 are electrically coupled to these various controllers.

The control system 10 also includes a distribution function circuit 32 having an output coupled as an input to the controller block 20. This distribution function circuit 32 includes, for example, a throttle valve distribution function circuit 34, an exhaust gas distribution function circuit 36, a supplemental fuel injection distribution function circuit 38 and a waste gate or variable nozzle turbine boost 40 distribution function circuit 40. The output from the distribution function circuit 32 is coupled as an input to the PID controller block 20 to control the actuation of the various individual PID controllers 22-28 in a manner subsequently described.

Figure 2:
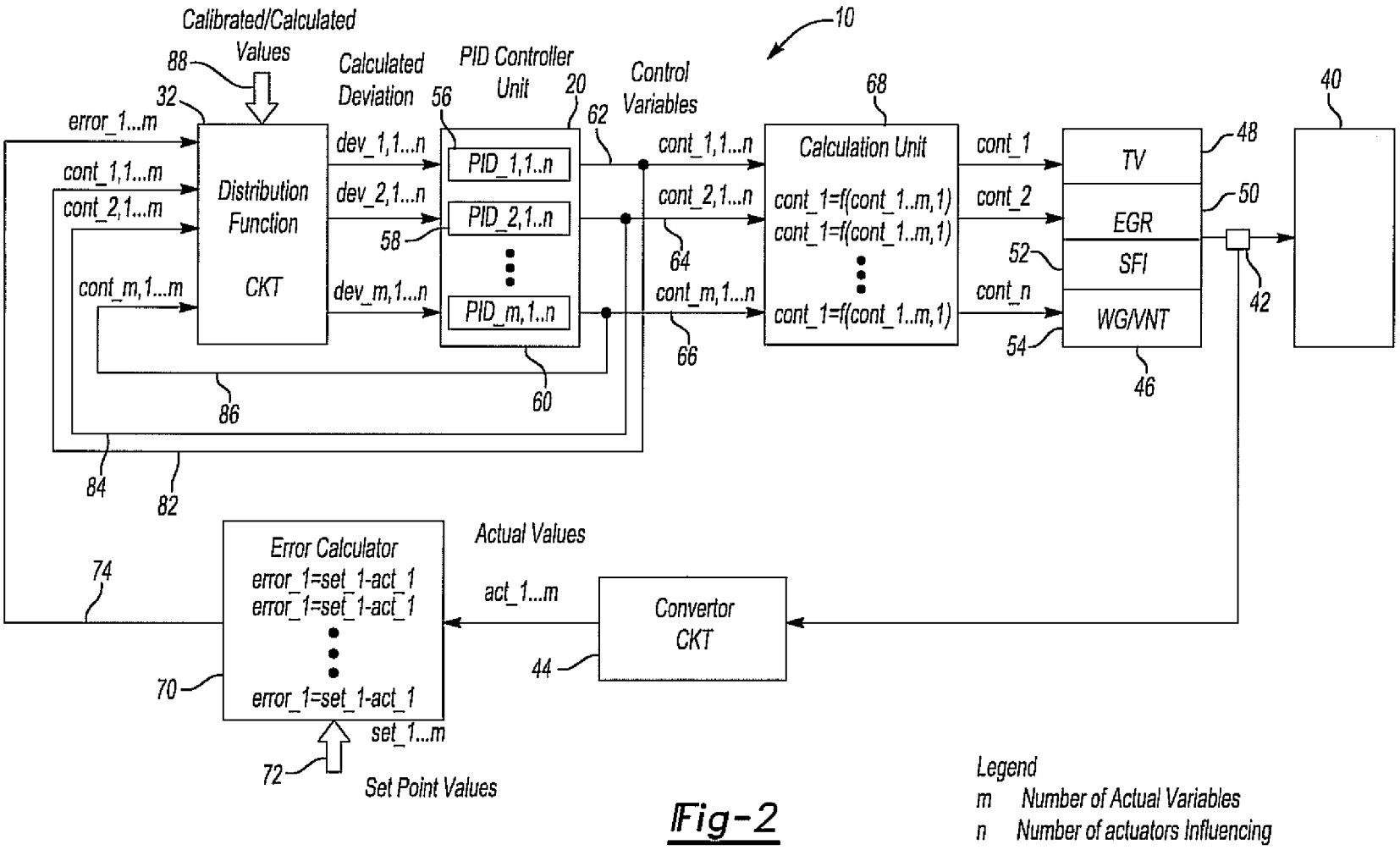
FIG. 2 is a block diagrammatic view of the engine control system.

With reference now to FIG. 2, the control system 10 is illustrated with an internal combustion engine 40 (illustrated only diagrammatically). The engine 40 includes one or more sensors 42 each of which provides an output signal representative of an engine operating condition. These engine operating conditions can include, for example, exhaust gas temperature, air/fuel ratio, and the like. The outputs from the sensors 42, furthermore, are coupled as an input signal to a converter circuit 44 which converts the output signal from each sensor 42 to an electrically usable form.

A plurality of actuators 46 are also associated with the internal combustion engine 40. These actuators include, for example, a throttle valve position actuator 48, an EGR actuator 50, a supplemental fuel injection actuator 52 and a waste gate or variable nozzle turbine 54. Each actuator 48-54 thus controls a particular engine parameter which, in turn, affects the exhaust stream from the engine 40. The input signals necessary to operate or actuate the actuators 48-54, furthermore, typically vary from each other.

At least one PID controller 56-60 in the PID controller block 20 is associated with each actuator 48-54. An output 62-66 from each PID controller 56-60, respectively, is electrically coupled through a calculation unit 68 to the various actuators 48-54. The calculation unit 68 converts the output from the PID controller 56-60 into the proper electrical signal necessary to actuate the actuator 48-54 to the desired position.

For example, assuming that the throttle valve position actuator 48 constitutes the first actuator, the first PID controller 56 generates an output signal on its output 62 to the calculation unit 68. The calculation unit 68 will then convert the output 62 from the PIED controller 56 to the appropriate signal for the throttle valve position actuator. For example, one actuator may require a pulse width modulation (PWM) while another engine actuator requires a change in voltage level to operate the actuator. The calculation unit 68 converts the outputs from the PID controllers 56-60 to the appropriate signal for its associated actuator 48-54.

Still referring to FIG. 2, an error calculation unit 70 receives the signals from each engine sensor 42 from the converter circuit 44 as an input. The error calculation unit 70 also receives an input 72 for a target value of each engine operating condition and then generates output signals error_1 . . . error_m on output lines 74 representative of the error or difference between the target value and actual value for the engine operating condition and where m=the number of variables or sensors.

The error signals on lines 74 from the error calculation unit 70 are coupled as input signals to the distribution function circuit 32. The function circuit 32 also receives as input signals a feedback signal on lines 82-86 from the output of each PID controller 56-60. Lastly, the distribution function circuit 32 receives one or more calculated factors on inputs 88.

The calculated factors on input lines 88 to the distribution function circuit 32 determine the weight or importance of each of the actuators 48-54 in achieving the desired target value of each engine operating condition. For example, the magnitude of the exhaust gas recirculation has a much greater impact on the exhaust gas temperature than, for example, the position of the throttle. Consequently, in order to achieve the desired target value for the exhaust gas recirculation, a much higher weight is assigned through the calculated factors on input line 88 to the distribution function circuit to the exhaust gas recirculation actuator than to the throttle valve actuator. The calculated factors may be determined in any conventional fashion such as empirically or through computer modeling.

The distribution function circuit 32 varies the input signal to each of the PID controllers 56-60 as a function of all of its input signals. These input signals include not only the error signals on line 74 and calculated factors on line 88, but also the feedbacks from the PID controller outputs on lines 82-86.

Figure 3:
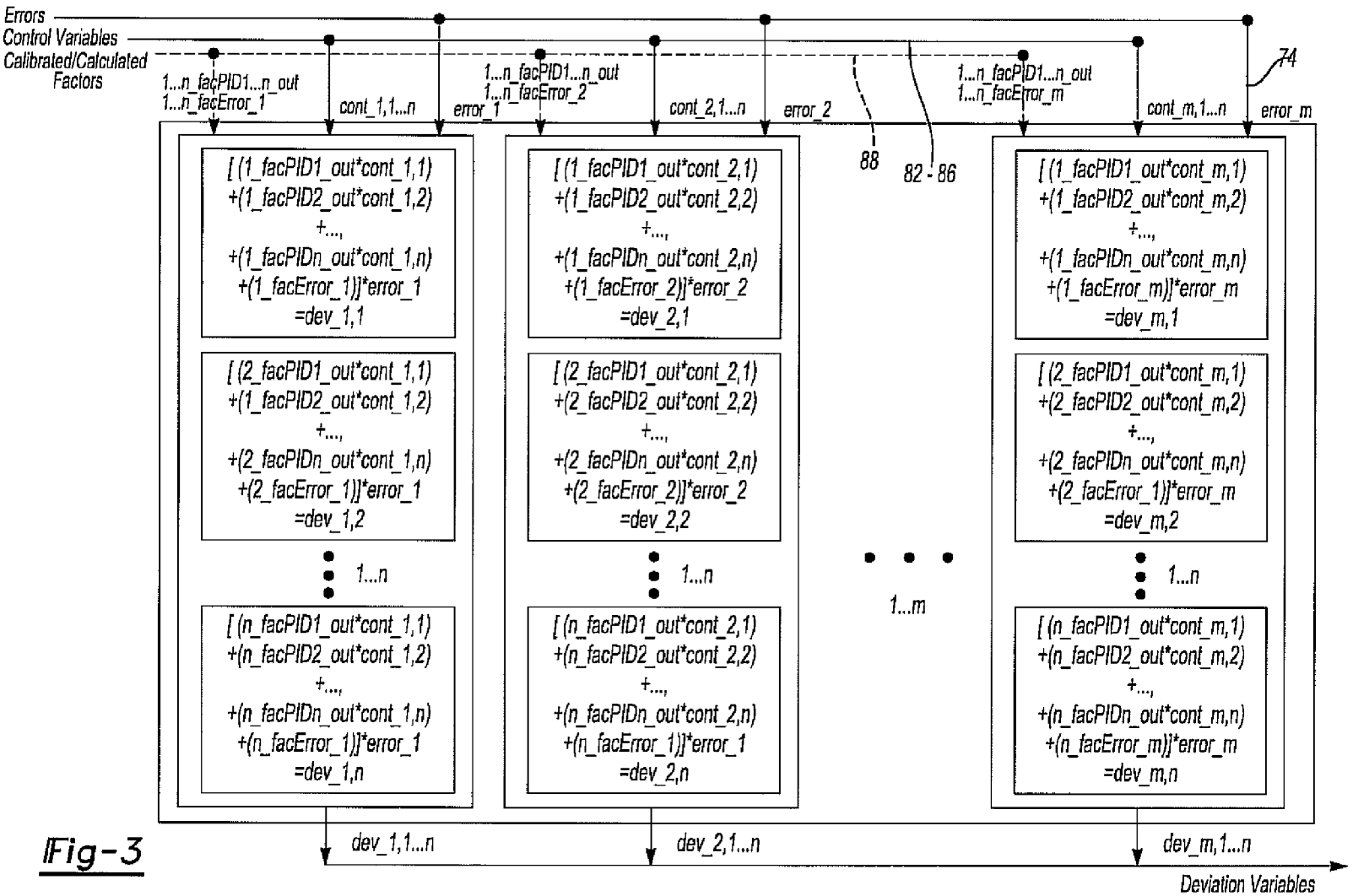
FIG. 3 is a block diagrammatic view illustrating an exemplary distribution function circuit.

With reference now to FIG. 3, an exemplary distribution function circuit is there shown for three PID controllers 56-60, although any number m of PID controllers may be used.

As can be seen, the deviation output dev_1, 1 . . . n . . . dev_m, 1 . . . n, which forms the input to the PID controller, varies as a function not only of the error signal error_1 . . . error_m on line 74 and the calculated factors 1 . . . n_facPID1 and 1 . . . n_facError_1 on line 88, but also is a function of the output cont_1, 1 . . . n . . . cont_m, 1 . . . n on the feedback from each of the other PID controllers 56-60. Consequently, the output signal from each PID controller 56-60 impacts, in an amount determined by the control factors on input line 88, the input signal to each other PID controller.

Figure 4:
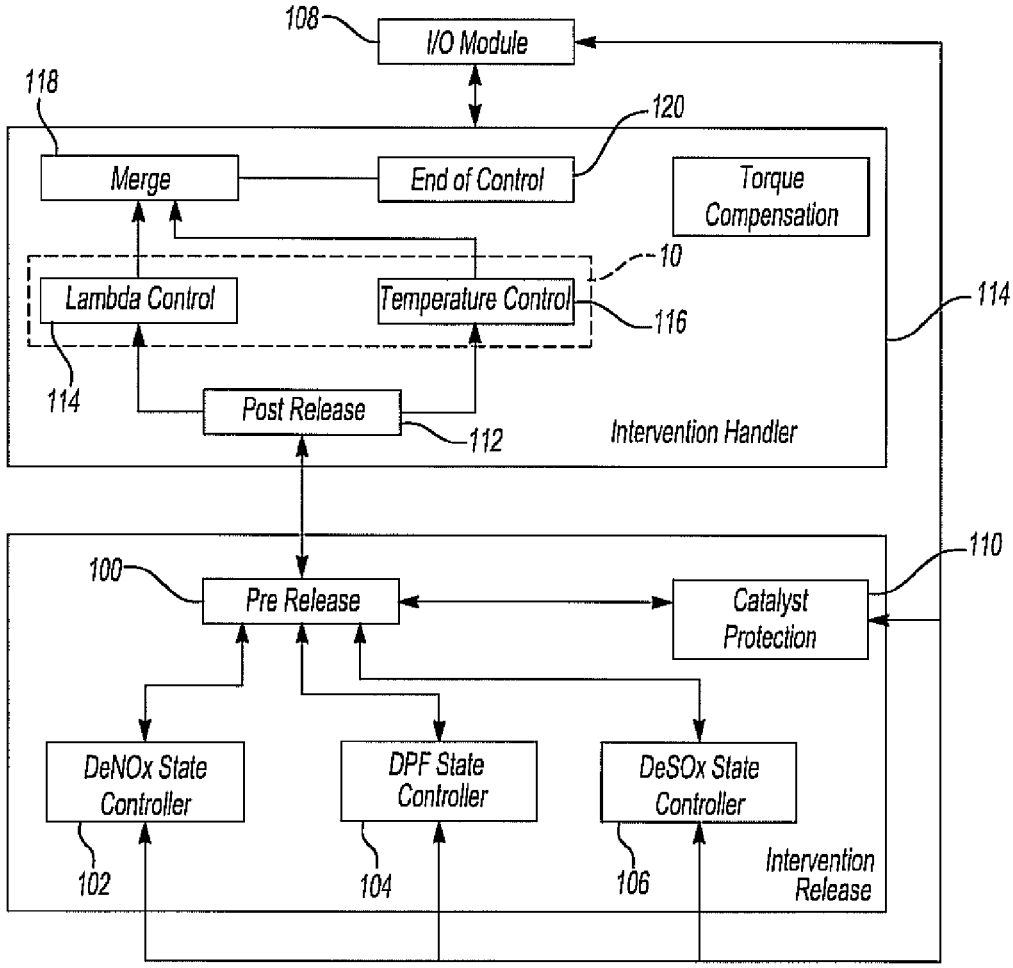
FIG. 4 is exemplary graphs illustrating the operation of the present invention.

With reference now to FIG. 4, an exemplary use of the control system 10 of the present invention is illustrated for maintenance of the engine exhaust system of a diesel engine. In this example, a Prerelease block 100 receives an input signal from a DeNOx state controller 102, a DPF (diesel particle filter) state controller 104 as well as a DeSOx state controller 106 through an input/output module 108. The input/output module 108, in turn, communicates with the engine management unit to determine the state of the controllers 102-106.

The prerelease block 100 also receives an input signal from the catalyst protection circuit 110 also through the input/output module 108.

The prerelease block 100 prioritizes any maintenance required from the catalyst protection circuit 110 or the controllers 102-106. Typically, the catalyst protection circuit 110 will receive the highest priority. Based upon this prioritization, the prerelease block 100 generates an output signal to a Postrelease block 112 in an intervention handler 114.

Utilizing the control system 10 of the present invention, the air/fuel ratio for the engine is controlled via a lambda controller 114. Similarly, the temperature control for the exhaust gas is also controlled through a temperature controller 116. The temperature control as well as the air/fuel ratio control is achieved by utilizing the desired target values as the input 72 (FIG. 2) to the error calculation and by the appropriate manipulation of the actuators 48-54 to achieve the target values for the air/fuel ratio as well as the exhaust gas temperature.

The outputs from the lambda controller 114 and temperature controller 116 are then merged in a merge block 118 and the intervention handler operation is terminated at block 120.

Figures 5A, 5B, 5C:
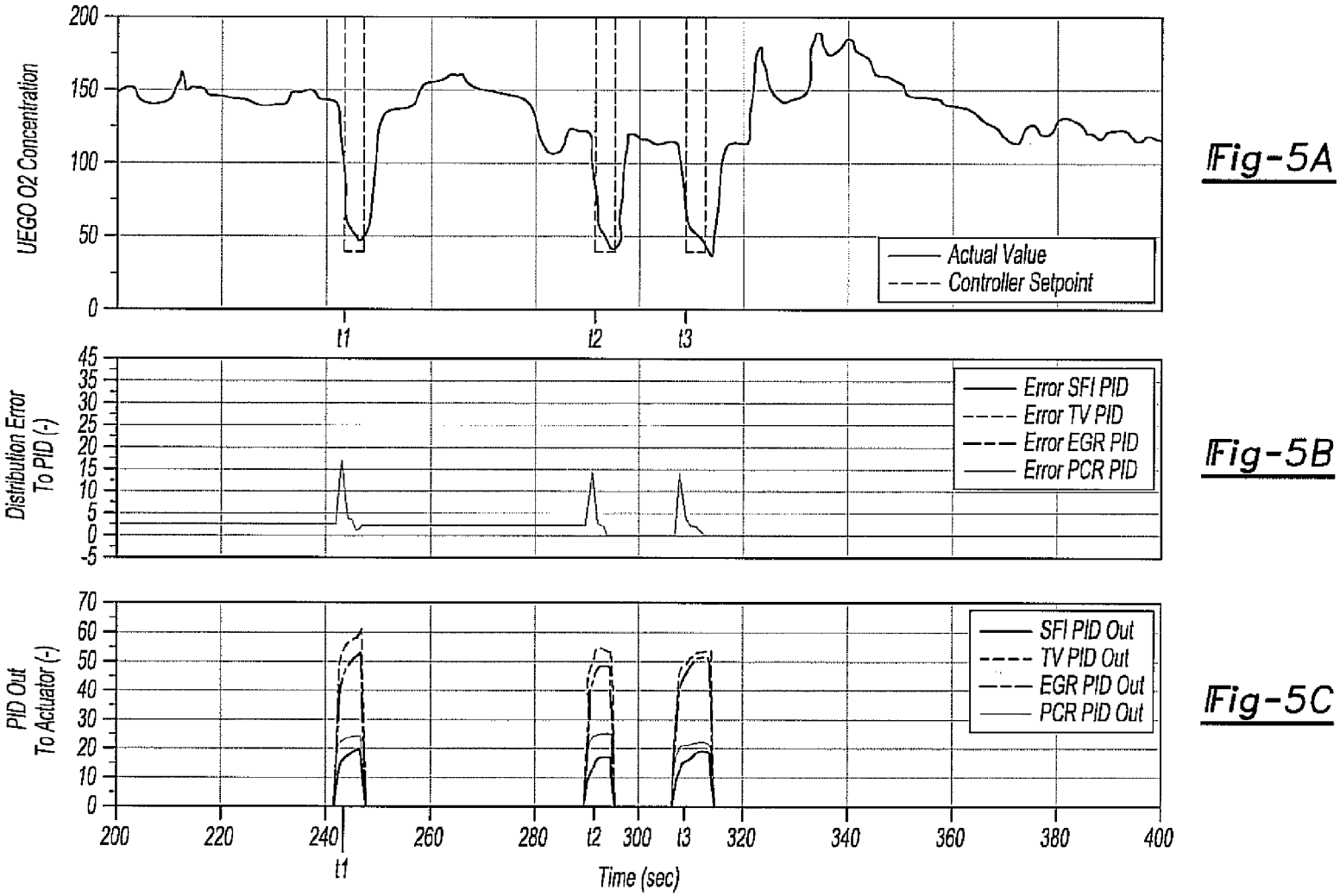
FIGS. 5A-5C graphically illustrate the operation of the present invention for controlling the air/fuel ratio for the engine.

With reference now to FIGS. 5A-5C, the operation of the present invention is there shown graphically. The graph 5A represents the oxygen content in the exhaust gas stream which correlates with the air/fuel ratio for the engine. Three controller set points are illustrated as beginning at times $t_0$, $t_2$ and $t_3$. FIG. 5C illustrates the PID outputs to the four actuators, while FIG. 5B illustrates the distribution error or deviation input dev_1, 1 . . . n to each of the PID controllers. As is clear from FIG. 5A, the actual value for the oxygen content in the exhaust stream closely approximates the controller set point.

Figures 6A, 6B, 6C:
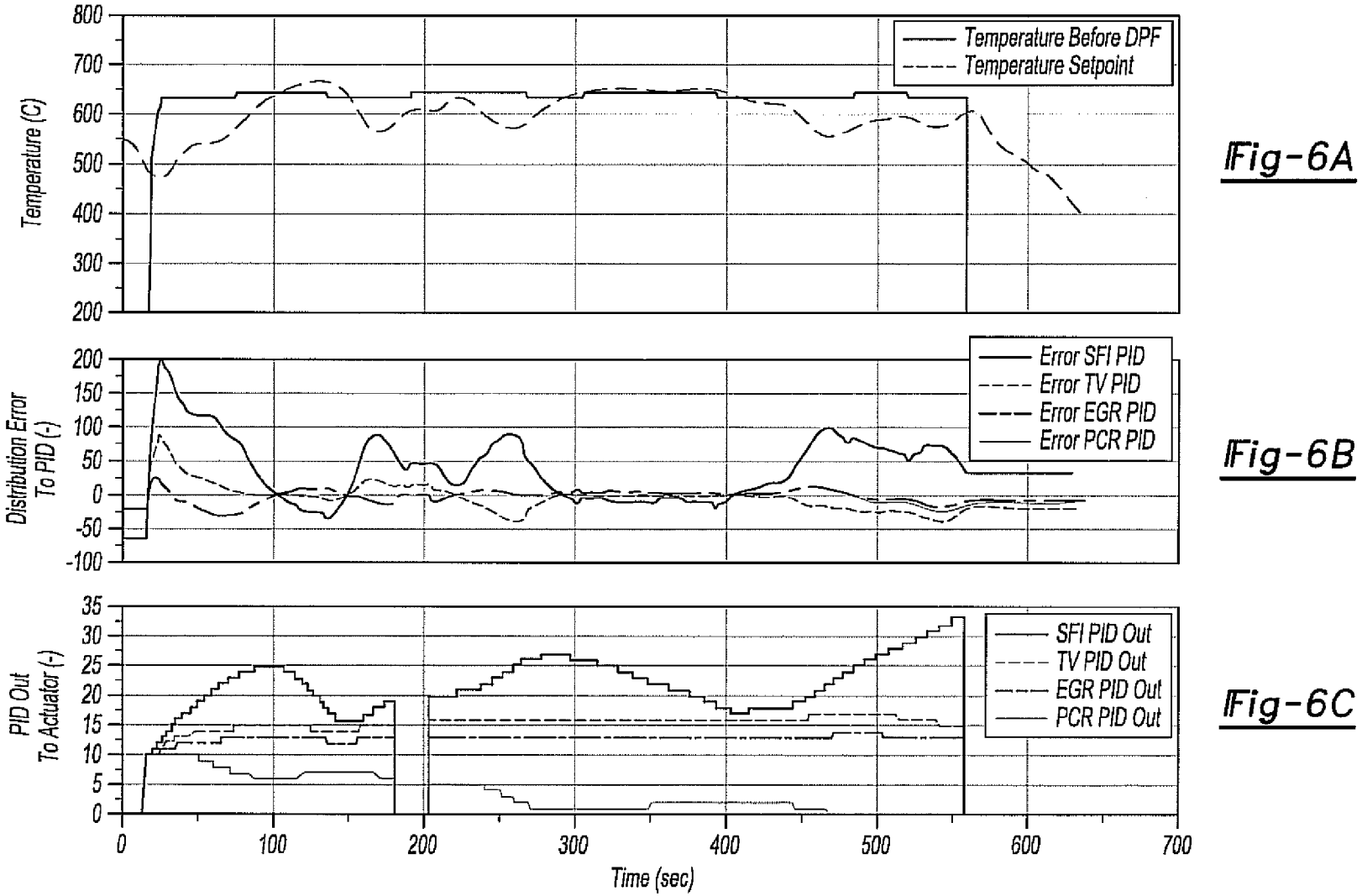
FIGS. 6A-6C graphically illustrate the operation of the present invention for controlling the exhaust gas temperature in an internal combustion engine.

FIGS. 6A-6C are analogous to FIGS. 5A-5C, but illustrate the control system 10 of the present invention utilized to control the exhaust gas temperature. FIG. 6A illustrates the temperature set point, i.e. the target temperature for the exhaust gas, while FIGS. 5B and 5C represent the distribution error or deviation to each of the PID controllers while FIG. 6C represents the PID output to each actuator. As can be seen from FIG. 6A, the control system enables the exhaust gas temperature to be closely tracked to its target value.

From the foregoing it can be seen that the present invention provides a simple engine control system particularly useful for controlling the exhaust gas system for an internal combustion engine. The present invention, by utilizing the distribution function circuit which varies the PID controller inputs as a function not only of the error of the particular actuator, but also of the outputs from the other PID controllers, without the previously known requirement for extensive software mapping and lookup tables.

Having described our invention, however, many modifications thereto will become apparent to those skilled in the art to which it pertains without deviation from the spirit of the invention as defined by the scope of the appended claims.

We claim:

1. A control system for an internal combustion engine having a plurality of actuators, each actuator controlling a predetermined engine parameter and a plurality of sensors, each sensor providing an output representative of an engine operating condition, said control system comprising:

a PID controller associated with each actuator, each PID controller having an input, an output and a feedback between said input and said output, a distribution function circuit operatively connected in series with the inputs of said PID controllers, said distribution function circuit receiving error signal(s) representative of the difference between a target value and an actual value of the engine operating condition(s), previously determined control factor values and the feedback from said PID controllers as distribution function input signals, said distribution function circuit varying the input to each PID controller as a function of said distribution function input signals.

2. The system as defined in claim 1 wherein the feedback of each PID controller forms a variable in said distribution function circuit for at least one other PID controller.

3. The system as defined in claim 1 wherein the feedback of each PID controller forms a variable in said distribution function circuit for each other PID controller.

4. The system as defined in claim 1 wherein said control factor values are determined empirically.

5. The system as defined in claim 1 wherein one PID controller is associated with an exhaust gas recirculation valve.

6. The system as defined in claim 1 wherein one PID controller is associated with a supplemental fuel injection device.

7. The system as defined in claim 1 wherein one PID controller is associated with a turbine boost device.

8. The system as defined in claim 1 wherein one PID controller is associated with a throttle valve.

9. The system as defined in claim 1 wherein one engine condition comprises exhaust gas temperature.

10. The system as defined in claim 1 wherein one engine condition comprises exhaust gas air/fuel ratio.

11. An exhaust control system for an internal combustion engine having a plurality of actuators, each actuator controlling a predetermined engine parameter and a plurality of sensors, each sensor providing an output representative of an engine operating condition, said control system comprising:

a PID controller associated with each actuator, each PIED controller having an input, an output and a feedback between said input and said output, a distribution function circuit operatively connected in series with the inputs of said PID controllers, said distribution function circuit receiving error signal(s) representative of the difference between a target value and an actual value of the engine operating condition(s), previously determined control factor values and the feedback from said PID controllers as distribution function input signals, said distribution function circuit varying the input to each PID controller as a function of said distribution function input signals.

12. The system as defined in claim 11 wherein the feedback of each PID controller forms a variable in said distribution function circuit for at least one other PID controller.

13. The system as defined in claim 11 wherein the feedback of each PID controller forms a variable in said distribution function circuit for each other PID controller.

14. The system as defined in claim 11 wherein said control factor values are determined empirically.

15. A method for controlling an internal combustion engine having a plurality of actuators, each actuator controlling a predetermined engine parameter and a plurality of sensors, each sensor providing an output representative of an engine operating condition, said method comprising the steps of:

associating a PID controller with each actuator, each PID controller having an input, an output and a feedback between said input and said output, operatively connecting a distribution function circuit in series with the inputs of said PID controllers, said distribution function circuit receiving error signal(s) representative of the difference between a target value and an actual value of the engine operating condition(s), previously determined control factor values and the feedback from said PID controllers as distribution function input signals, said distribution function circuit varying the input to each PID controller as a function of said distribution function input signals.

16. The method as defined in claim 15 and further comprising the step of varying the input of at least one PID controller as a function of the feedback from at least one other PID controller in the distribution function circuit.

17. The method as defined in claim 15 and further comprising the step of varying the input of each PID controller as a function of the feedback from each other PID controller in the distribution function circuit.

* * * * *

UNITED STATES PATENT AND TRADEMARK OFFICE

CERTIFICATE OF CORRECTION

PATENT NO. : 7,412,965 B1
APPLICATION NO. : 11/735110
DATED : August 19, 2008
INVENTOR(S) : Martin Laermann et al.

It is certified that error appears in the above-identified patent and that said Letters Patent is hereby corrected as shown below:

On the title page, item [73]: Add FEV Motorentechnik GmbH as the assignee,

Column 1, line 46, in the heading replace “TEE” with --THE--

Column 2, line 25, replace “PIE” with --PID--

Column 3, line 65, replace “PIED” with --PID--

Column 6, line 31, replace “PIED” with --PID--

Signed and Sealed this

Twenty-fourth Day of March, 2009

JOHN DOLL
*Acting Director of the United States Patent and Trademark Office*